US008752956B2

(12) United States Patent
Bitoh

(10) Patent No.: US 8,752,956 B2
(45) Date of Patent: Jun. 17, 2014

(54) NAIL PRINT APPARATUS

(75) Inventor: Hiroyasu Bitoh, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 53 days.

(21) Appl. No.: 13/549,688

(22) Filed: Jul. 16, 2012

(65) Prior Publication Data

US 2013/0021395 A1 Jan. 24, 2013

(30) Foreign Application Priority Data

Jul. 19, 2011 (JP) ..... 2011-157595

(51) Int. Cl.

| | |
|---|---|
| ***B41J 29/13*** | (2006.01) |
| ***B41J 3/36*** | (2006.01) |
| ***B41J 3/44*** | (2006.01) |
| *B41J 3/407* | (2006.01) |
| *B41J 2/175* | (2006.01) |

(52) U.S. Cl.

CPC .. *B41J 3/36* (2013.01); *B41J 3/445* (2013.01); *B41J 3/407* (2013.01); *B41J 2/17513* (2013.01)

USPC ..... 347/108

(58) Field of Classification Search

CPC ..... B41J 3/407; B41J 3/4073; B41J 29/02; B41J 3/445; B41J 2/17513

USPC ..... 347/2, 108, 109

See application file for complete search history.

(56) References Cited

U.S. PATENT DOCUMENTS

| | | | | |
|---|---|---|---|---|
| 5,931,166 | A * | 8/1999 | Weber et al. | 132/73 |
| 6,067,996 | A * | 5/2000 | Weber et al. | 132/73 |
| 6,336,694 | B1 * | 1/2002 | Ishizaka | 347/2 |

FOREIGN PATENT DOCUMENTS

JP 2000-194838 A 7/2000

OTHER PUBLICATIONS

U.S. Appl. No. 13/549,670; First Named Inventor: Hiroyasu Bitoh; Title: "Nail Print Apparatus"; filed Jul. 16, 2012.

* cited by examiner

*Primary Examiner* — An Do

(74) *Attorney, Agent, or Firm* — Holtz Holtz Goodman & Chick PC

(57) ABSTRACT

A nail print apparatus includes a print head which performs printing on a finger nail, a printing finger positioning unit which holds a fingertip of the finger nail on which the print head performs printing, non-printing finger receiving units which are provided respectively at sides of the printing finger positioning unit and which receive fingers other than the finger held by the printing finger positioning unit, and a placement unit on which at least the fingertip of the finger received by the printing finger positioning unit is placed.

10 Claims, 11 Drawing Sheets

NAIL PRINT APPARATUS

BACKGROUND OF THE INVENTION

1. Field of the Invention

The present invention relates to a nail print apparatus.

2. Description of Related Art

In Japanese Patent Application Laid Open Publication No. 2000-194838, there is described a nail print apparatus in which a finger (printing finger) corresponding to a nail on which printing is to be performed is positioned on a placement unit which is provided in the apparatus main body and an image such as a design is to be printed on the nail of the positioned finger.

However, the apparatus in the Japanese Patent Application Laid Open Publication No. 2000-194838 is configured such that fingers (non-printing fingers) other than the printing finger are placed on the front side of a case main body of the nail print apparatus when printing processing is performed. Therefore, the non-printing fingers are cramped and a feeling of pressure is created when the non-printing fingers are pressed against the front side of the case main body.

On the other hand, if the non-printing fingers are not pressed against the front side of the case main body during printing processing, it will be difficult to hold the printing finger in a predetermined position during the printing processing.

SUMMARY OF THE INVENTION

The present invention was made in consideration of such problems, and an object of the present invention is to provide a nail print apparatus in which a printing finger is easily held in a predetermined position and excessive burden is not imposed on non-printing fingers.

According to one aspect of the present invention, a nail print apparatus includes a print head which performs printing on a finger nail, a printing finger positioning unit which holds a fingertip of the finger nail on which the print head performs printing, non-printing finger receiving units which are provided at both sides of the printing finger positioning unit and can receive fingers other than the finger held by the printing finger positioning unit, and a placement unit on which at least the fingertip of the finger received by the printing finger positioning unit is placed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

First Embodiment

The first embodiment of the nail print apparatus according to the present invention will be explained referring to FIGS. 1 to 6.

Figure 1:
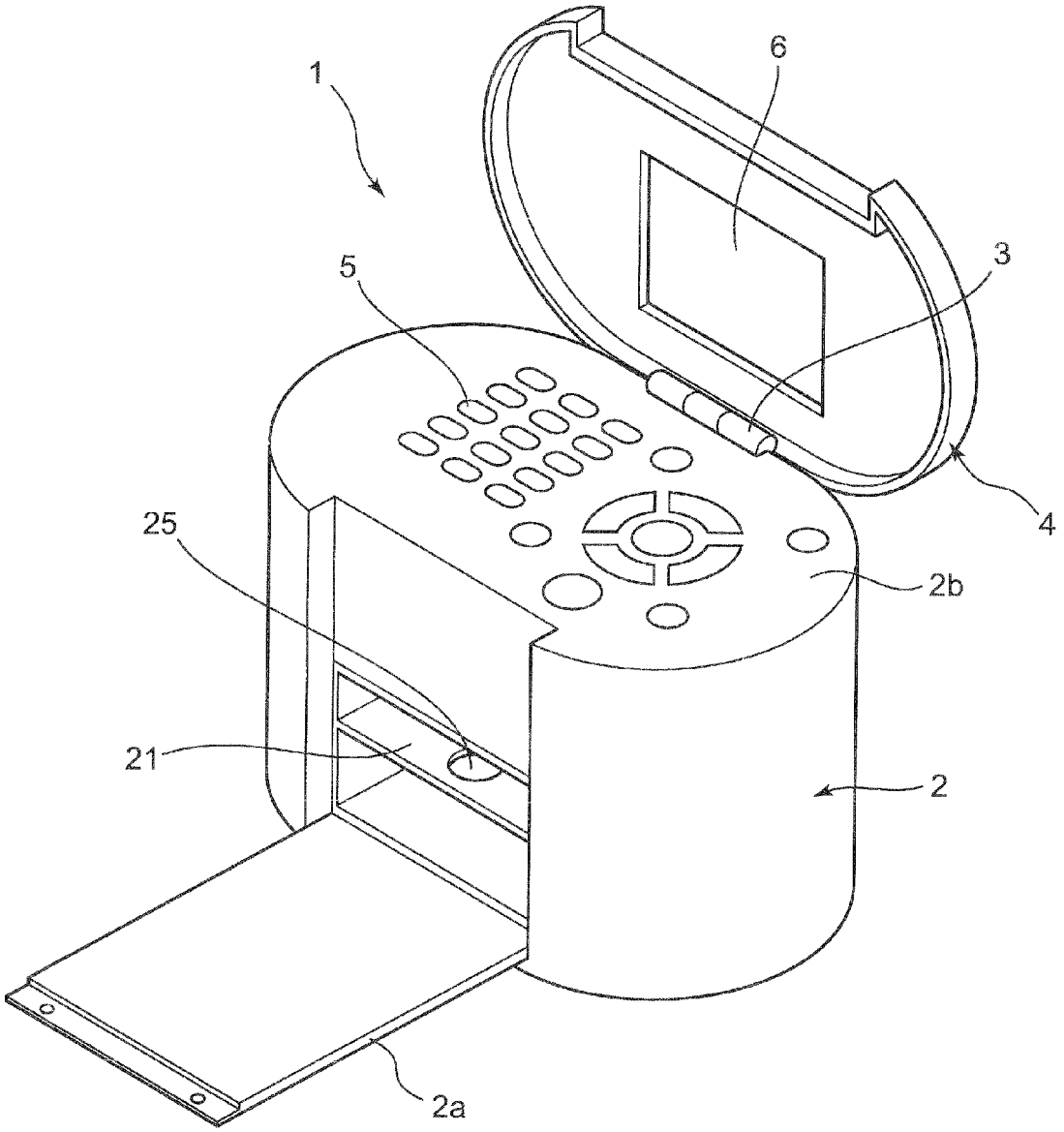
FIG. 1 is a perspective view of the first embodiment of the nail print apparatus according to the present invention.

As shown in FIG. 1, a nail print apparatus 1 includes a case main body 2 and a cover 4.

A display unit 6 is provided on the inner surface of the cover 4. The display unit 6 is configured by including a liquid crystal panel (LCD: Liquid Crystal Display) and such like, for example. On the display unit 6, a photographed finger nail image of a printing finger, the nail in the finger nail image, the outline of the printing finger, a nail image pattern to be printed on the nail of the printing finger, thumbnail images for confirming the design and such like are arbitrarily displayed, for example.

The cover 4 is joined to the case main body 2 via a hinge 3 which is provided at the rear end portion of the upper surface of the case main body 2.

On the other hand, the case main body 2 is formed in an oval shape in a plan view. An opening/closing plate 2*a* is provided at the front side of the case main body 2 so as to be able to flip up and down. The opening/closing plate 2*a* is joined to the case main body 2 via a hinge (not shown in the drawings) which is provided at the lower end portion of the front surface of the case main body 2.

An operation panel 5 is set on the upper surface 2*b* of the case main body 2. On the operation panel 5, operation buttons to perform various types of inputs as well as a power switch button to turn on the nail print apparatus 1 are disposed, for example.

Figure 2:
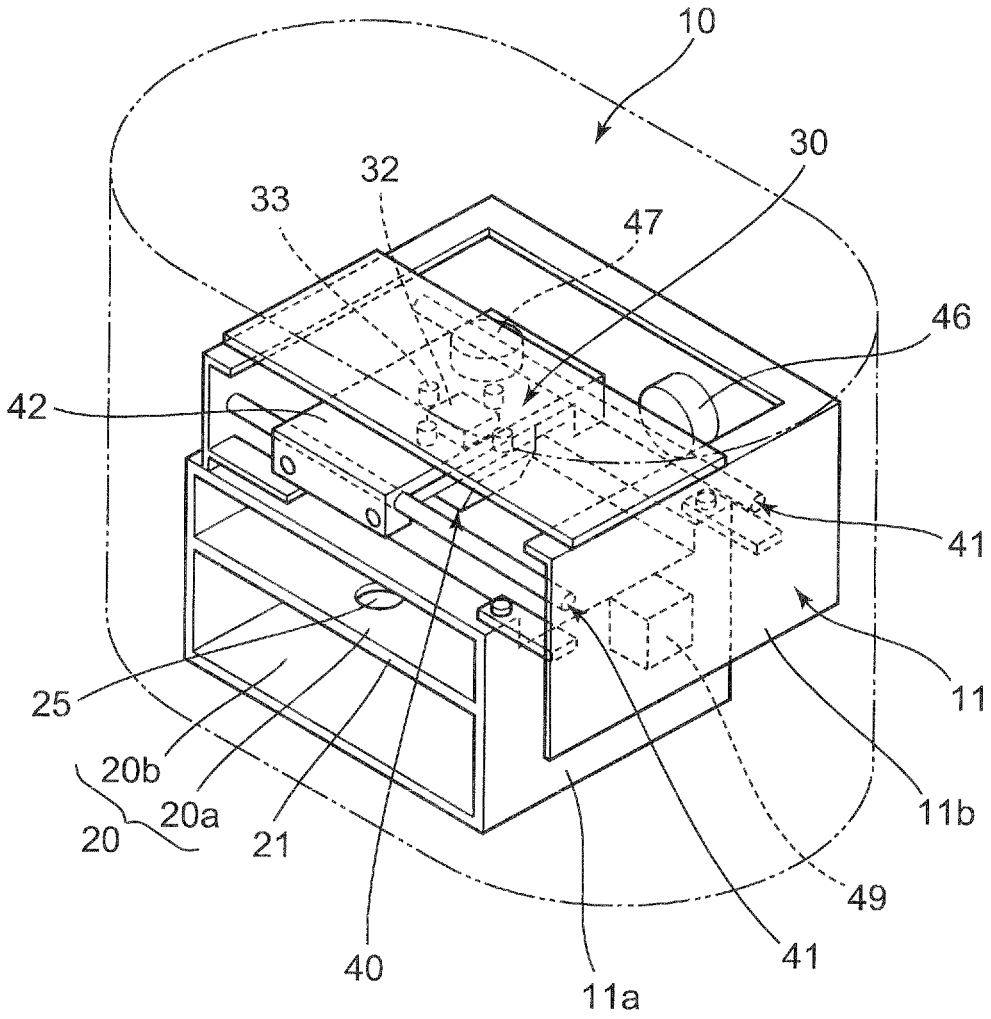
FIG. 2 is a perspective view of an apparatus main body of the nail print apparatus of FIG. 1.

In addition, an apparatus main body 10 of the nail print apparatus 1 is provided inside the case main body 2 as shown in FIG. 2.

The apparatus main body 10 includes a finger receiving unit 20, a photographing unit 30 and a printing unit 40.

A machine casing 11 of the apparatus main body 10 is configured by including a lower machine casing 11*a* and an upper machine casing 11*b*. The lower machine casing 11*a* is formed in a box shape and the front side of the inner space is opened. The lower machine casing 11*a* is set at lower side in the case main body 2. On the other hand, the upper machine casing 11*b* is set above the lower machine casing 11*a*.

The finger receiving unit 20 is configured by including the upper first finger receiving unit 20*a* and the lower second finger receiving unit 20*b*, and the first finger receiving unit 20*a* and the second finger receiving unit 20*b* are divided by a placement unit 21 therebetween.

Figure 3:
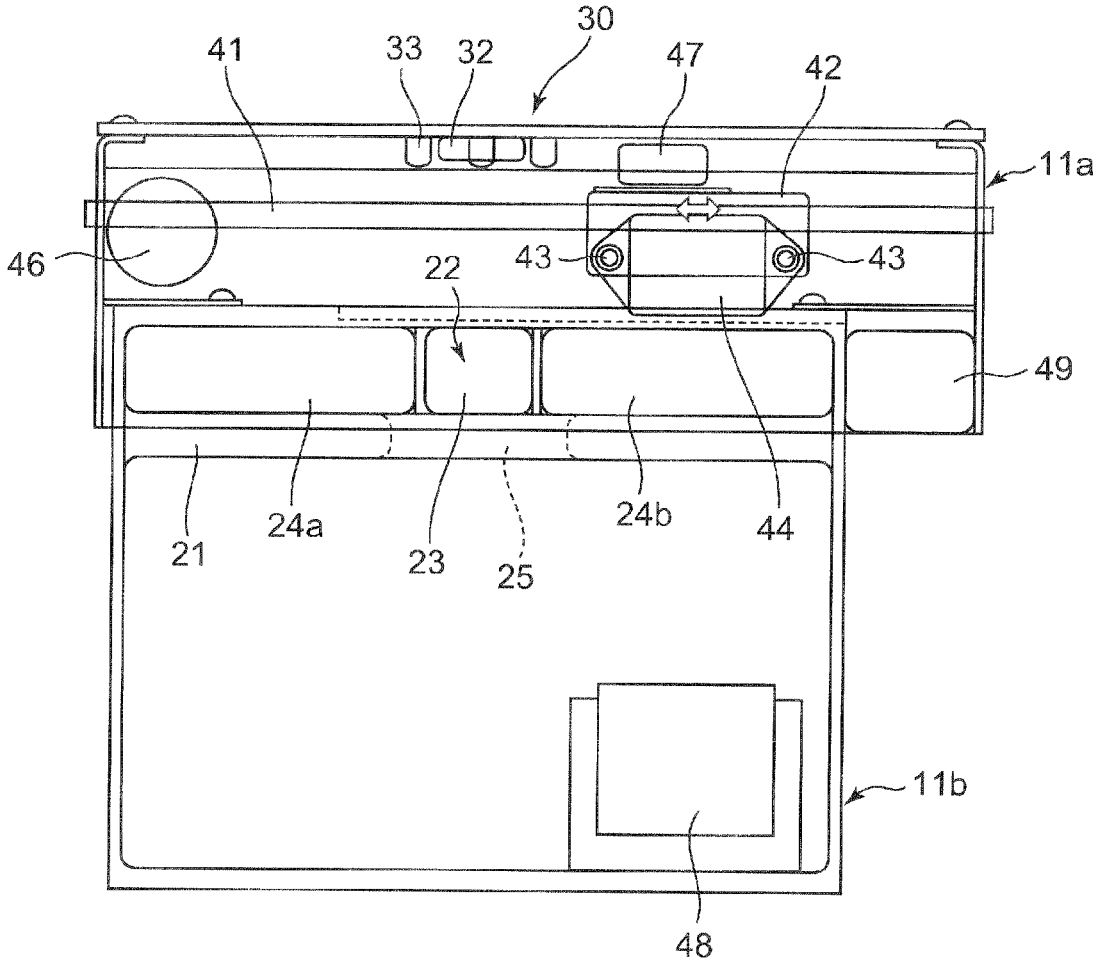
FIG. 3 is a sectional view of the apparatus main body of FIG. 2 seen from the front.
Figure 5A:
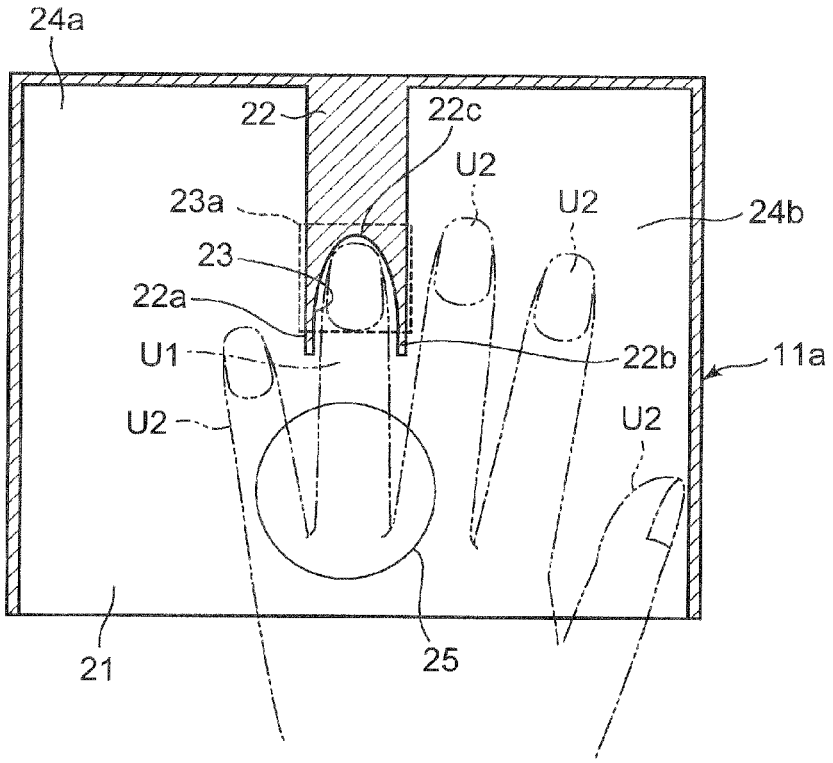
FIG. 5A is a diagram of finger receiving unit of the nail print apparatus of FIG. 1, which is a plan view of a part of the first finger receiving unit.
Figure 5B:
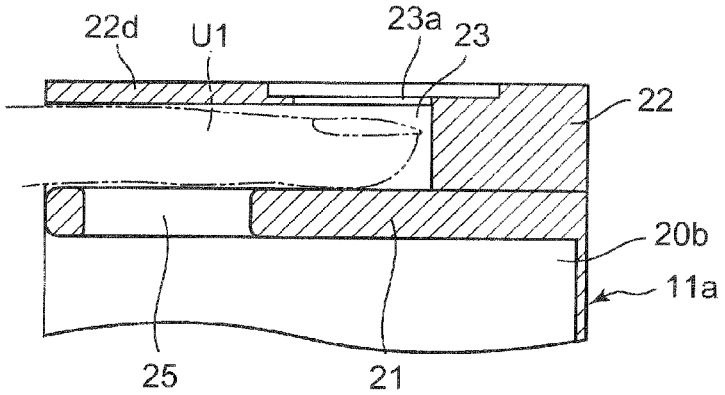
FIG. 5B is a diagram of finger receiving unit of the nail print apparatus of FIG. 1, which is a sectional view of a printing finger positioning unit and a part of the second finger receiving unit seen from the right side.

A printing finger positioning unit 22 is formed nearly at the center in the width direction of the first finger receiving unit 20*a* as shown in FIGS. 3 and 5. A printing finger inlet port 23 in which the front side thereof is opened is formed in the printing finger positioning unit 22. In the printing finger inlet port 23, the bottom side is defined by the placement unit 21, right and left sides are defined respectively by dividers 22*a* and 22*b*, the back side is defined by a nail abutting portion 22*c* and the top side is defined by a top wall 22*d* of the lower machine casing 11*a* as shown in FIGS. 5A and 5B. A window 23*a* to expose the nail of the printing finger which is inserted in the printing finger inlet port 23 is formed at the top wall 22*d* of the lower machine casing 11*a*.

Additionally, non-printing finger receiving units 24*a* and 24*b* are formed at both sides of the printing finger positioning unit 22 in the first finger receiving unit 20*a*. The non-printing finger receiving units 24*a* and 24*b* are used when any one of the index finger, middle finger, ring finger and little finger is to be the printing finger.

Figure 5C:
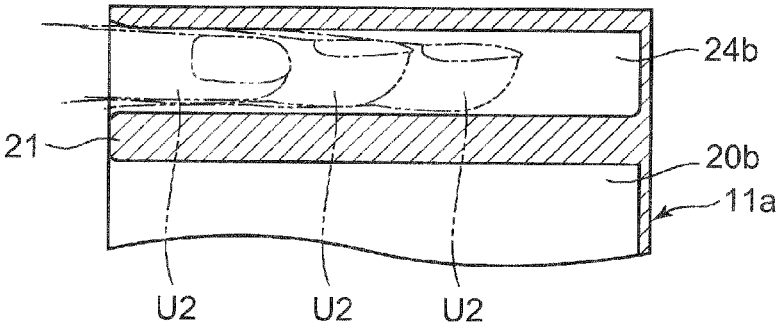
FIG. 5C is a diagram of finger receiving unit of the nail print apparatus of FIG. 1, which is a sectional view of a non-printing finger receiving unit and a part of the second finger receiving unit seen from the right side.

Specifically, when the ring finger of the left hand is to be the printing finger U1 as shown in FIGS. 5A and 5B, a user inserts the ring finger which is the printing finger U1 in the printing finger inlet port 23, and inserts the little finger which is a non-printing finger U2 to the non-printing finger receiving unit 24*a* on the left of the printing finger positioning unit 22 as shown in FIG. 5A. On the other hand, a user inserts the thumb, index finger and middle finger which are non-printing fingers U2 in the non-printing finger receiving unit 24*b* on the right of the printing finger positioning unit 22 as shown in FIGS. 5A and 5C.

To generalize this, a user inserts the printing finger which is any one of index finger, middle finger, ring finger and little finger in the printing finger inlet port 23, inserts non-printing fingers which are located on the left of the printing finger in the non-printing finger receiving unit 24*a* on the left of the printing finger positioning unit 22 and inserts non-printing fingers which are located on the right of the printing finger in the non-printing receiving unit 24*b* on the right of the printing finger positioning unit 22.

Figure 6:
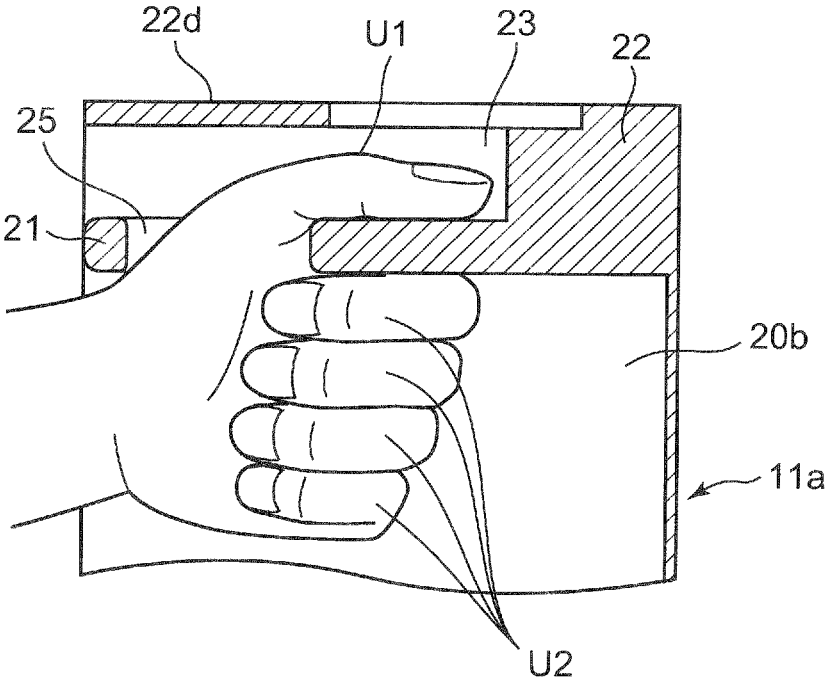
FIG. 6 is a sectional view of the printing finger positioning unit and a part of the second finger receiving unit of the nail print apparatus of FIG. 1 seen from the right side.

Also, the second finger receiving unit 20*b* is formed below the placement unit 21. A thumb hole unit 25 which is vertically penetrated is formed in the placement unit 21 as shown in FIGS. 5B and 6. The thumb hole unit 25 is formed immediately before (right in front of) the printing finger inlet port 23.

When the thumb is to be the printing finger U1 as shown in FIG. 6, all the fingers of the hand which includes the thumb which is the printing finger U1 are inserted in the second finger receiving unit 20*b* first, thereafter, only the thumb which is the printing finger U1 is inserted through the thumb hole unit 25 from below, and further, the fingertip of the thumb is inserted in the printing finger inlet port 23. Thus, the index finger, middle finger, ring finger and little finger which are the non-printing fingers U2 other than the thumb which is the printing finger U1 are kept in the second finger receiving unit 20*b*. At that time, the non-printing fingers U2 which are kept in the second finger receiving unit 20*b* are in a state of a loose fist. In this case, the non-printing fingers U2 which are kept in the second finger receiving unit 20*b* may also be in an extended state.

When photographing processing or printing processing of the thumb which is the printing finger U1 is to be performed, it is preferable that the placement unit 21 is sandwiched between the printing finger U1 and the non-printing fingers U2. By doing so, the printing finger U1 can be stably held in a predetermined position.

Figure 4:
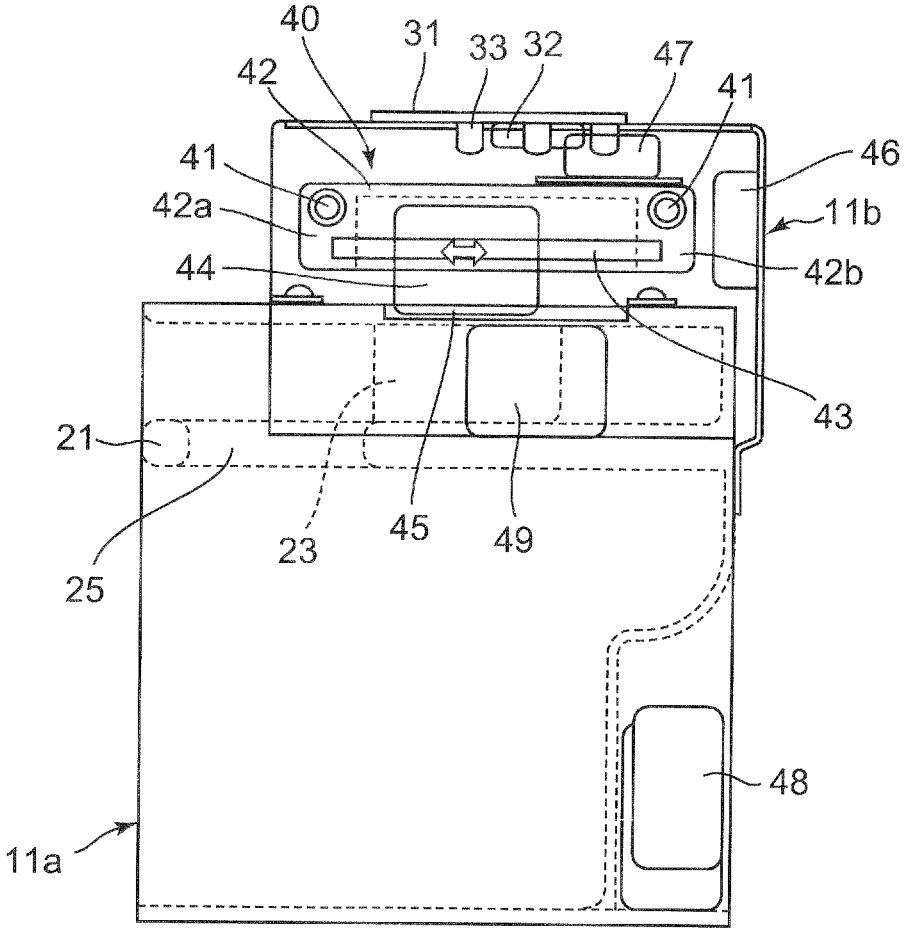
FIG. 4 is a sectional view of the apparatus main body of FIG. 2 seen from the right side.

Further, the photographing unit 30 is provided at the upper machine casing 11*b* in the machine casing 11 as shown in FIGS. 2 to 4. That is, a camera 32 is set at the central part on the lower surface of a substrate 31 which is disposed on the upper machine casing 11*b*. In addition, lights 33, such as white LED, are set on the substrate 31 so as to surround the camera 32.

The photographing unit 30 illuminates the printing finger which is inserted in the printing finger inlet port 23 and exposed from the window 23*a* with the lights 33, and photographs the printing finger with the camera 32 to obtain a finger nail image.

The print unit 40 prints an image on the nail of the printing finger according to printing data. Main parts of the print unit 40 are provided in the upper machine casing 11*b*.

Specifically, two guide rods 41 are bridged in parallel to each other between the two side boards of the upper machine casing 11*b* as shown in FIG. 2. A main carriage 42 is slidably attached to the guide rods 41. Also, two guide rods 43 are bridged in parallel to each other between the front wall 42*a* and the rear wall 42*b* of the main carriage 42 as shown in FIG. 4. A secondary carriage 44 is slidably attached to the guide rods 43. A print head 45 is mounted on the central part of the lower surface of the secondary carriage 44. Though the print head 45 is not limited specifically, the print head 45 is an ink-jet type print head which makes ink be in the form of micro droplets and directly sprays the ink droplets onto a target to be printed to perform printing.

Also, the main carriage 42 is joined to a motor 46 via a power transmitting unit (not shown in the drawings) and moves to the left and right along the guide rods 41 by the forward-reverse rotation of the motor 46. The secondary carriage 44 is joined to a motor 47 via a power transmitting unit (not shown in the drawings) and moves back and forth along the guide rods 43 by the forward-reverse rotation of the motor 47.

An ink cartridge 48 for supplying ink to the print head 45 is provided in the lower machine casing 11*a*. The ink cartridge 48 is connected to the print head 45 via an ink supply tube (not shown in the drawings), and the ink cartridge 48 appropriately supplies ink to the print head 45.

A head cleaning unit 49 is disposed between the upper portion side of the lower machine casing 11*a* and the side board of the upper machine casing 11*b* so as to face the moving range of the print head 45.

According to the nail print apparatus 1 in such configurations, following advantages are obtained.

That is, while the printing finger is held by the printing finger positioning unit 22, excessive burden is not imposed on non-printing fingers because the non-printing fingers are received by the first non-printing finger receiving units 24*a* and 24*b* in an extended state.

On the other hand, because the non-printing fingers as well as the printing finger are placed on the placement unit 21, the printing finger can be stably held in a predetermined position by pressing the fingertips of the printing finger and the non-printing fingers against the placement unit 21.

Further, because the nail of the printing finger can be held at the position of the same depth in the printing finger inlet port 23 whichever finger is to be the printing finger, photographing range of the photographing unit which photographs the printing finger and printing operation range of the print head 45 which performs printing on the printing finger can be smaller.

Also, because the thumb hole unit 25 is formed, a thumb which is to be the printing finger can be inserted deeply enough in the printing finger inlet port 23.

Second Embodiment

Figure 7A:
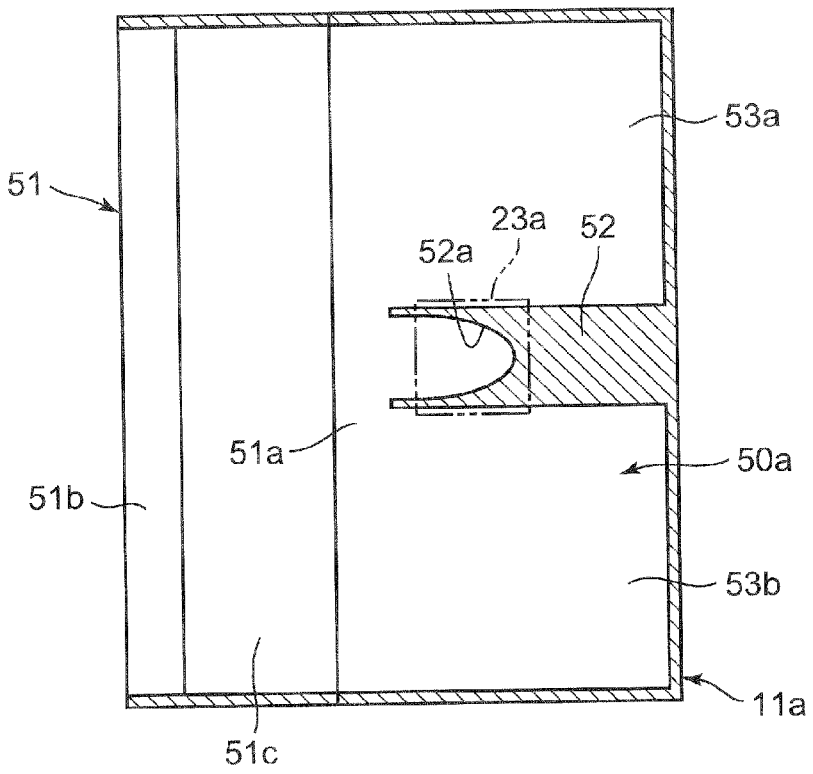
FIG. 7A is a diagram of finger receiving unit of the second embodiment of the nail print apparatus according to the present invention, which is a plan view of a part of a first finger receiving unit.
Figure 7B:
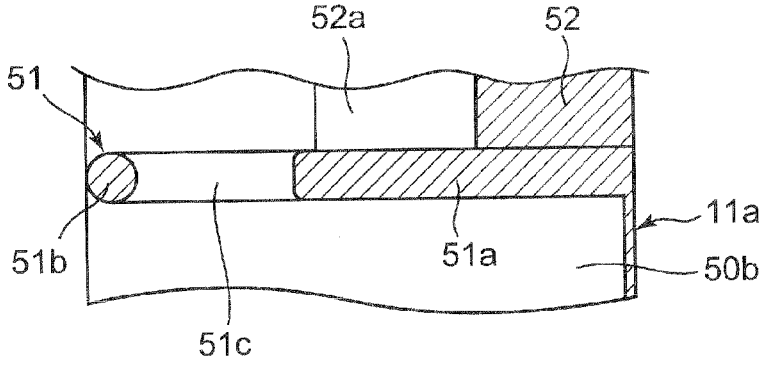
FIG. 7B is a diagram of finger receiving unit of the second embodiment of the nail print apparatus according to the present invention, which is a sectional view of a part of a printing finger positioning unit and a part of a second finger receiving unit seen from the right side.

FIGS. 7A and 7B illustrate the placement unit of a nail print apparatus of the second embodiment.

As shown in FIG. 7A, a placement unit 51 of the nail print apparatus 1 includes a placement board 51*a* on which fingertips are placed, a placement bar 51*b* which is located in front of the placement board 51*a* and bases or roots of fingers are placed thereon, and a thumb hole unit 51*c* which is formed between the placement board 51*a* and the placement bar 51*b*. Here, the base of the finger includes the palm. The same shall apply hereinafter.

A printing finger positioning unit 52 which includes a printing finger inlet port 52*a* is provided on the placement board 51*a*, and non-printing finger receiving units 53*a* and 53*b* are formed respectively at the sides of the printing finger positioning unit 52. The printing finger positioning unit 52 and the non-printing finger receiving units 53*a* and 53*b* constitute a first finger receiving unit 50*a*.

The non-printing finger receiving units 53*a* and 53*b* are used when any one of the index finger, middle finger, ring finger and little finger is to be the printing finger.

That is, in the nail print apparatus 1, the printing finger which is anyone of the index finger, middle finger, ring finger and little finger is inserted in the printing finger inlet port 52*a*, the non-printing fingers located on the left of the printing finger are inserted in the non-printing finger receiving unit 53*a* which is on the left of the printing finger positioning unit 52 and non-printing fingers located on the right of the printing finger are inserted in the non-printing finger receiving unit 53*b* which is on the right of the printing finger positioning unit 52, for example. Then, bases or roots of the printing finger and non-printing fingers are placed on the placement board 51*a* and the placement bar 51*b*.

In addition, a second finger receiving unit 50*b* is formed below the placement unit 51 as shown in FIG. 7B. The second finger receiving unit 50*b* is for receiving the non-printing fingers when the printing finger is the thumb. Further, the thumbhole unit 51*c* located between the placement board 51*a* and the placement bar 51*b* is formed immediately before (right in front of) the printing finger inlet port 52*a*. After the thumb which is the printing finger is inserted through the thumbhole unit 51*c* from below, the fingertip of the thumb is inserted in the printing finger inlet port 52*a*.

Other configurations of the second embodiment are similar to the configurations of the first embodiment. Therefore, explanation of the other configurations of the second embodiment is omitted.

According to the nail print apparatus 1 of the second embodiment, following advantages are obtained.

That is, according to the nail print apparatus 1 of the second embodiment, when any one of the index finger, middle finger, ring finger and little finger is to be the printing finger, because bases or roots of the printing finger and the non-printing fingers are placed on the placement board 51*a* and the placement bar 51*b* which is apart from the placement board 51*a*, the fingertips can be held with strength to stably support the printing finger.

Third Embodiment

Figure 8A:
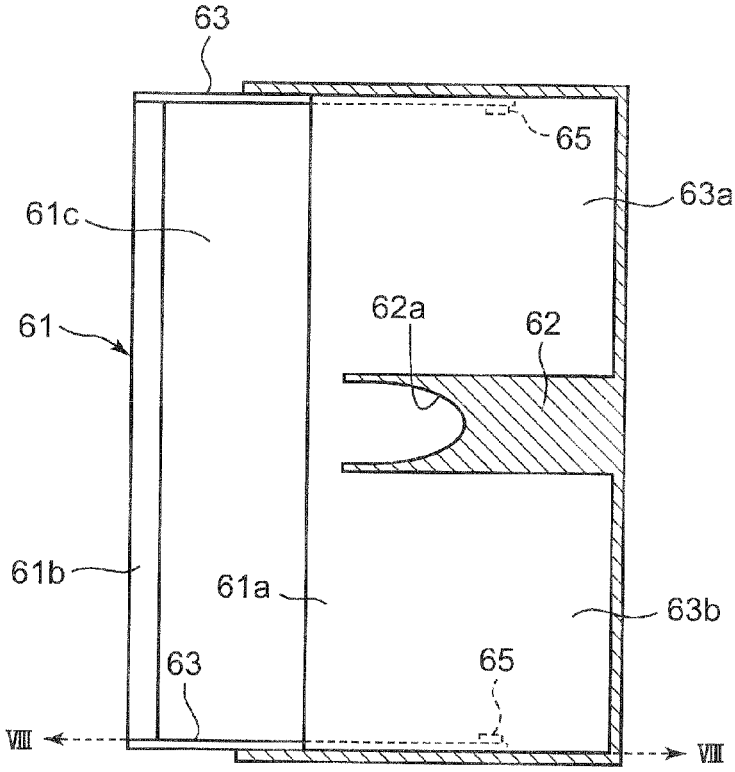
FIG. 8A is a diagram of finger receiving unit of the third embodiment of the nail print apparatus according to the present invention, which is a plan view of a part of a first finger receiving unit.
Figure 8B:
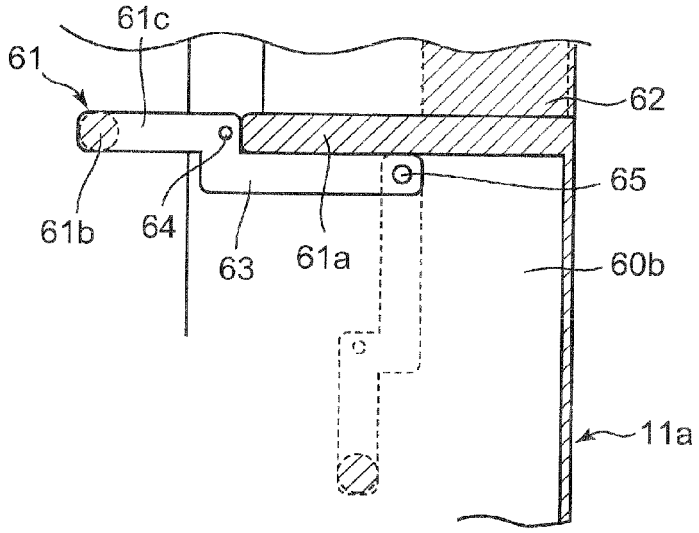
FIG. 8B is a diagram of finger receiving unit of the third embodiment of the nail print apparatus according to the present invention, which is a sectional view of a part of a printing finger positioning unit and a part of a second finger receiving unit seen from the right side cut along the line VIII-VIII shown in FIG. 8A.

FIGS. 8A and 8B illustrate a placement unit of the nail print apparatus of the third embodiment.

As shown in FIG. 8A, a placement unit 61 of the nail print apparatus 1 includes a placement board 61*a* on which fingertips are placed, a placement bar 61*b* which is located in front of the placement board 61*a* and bases or roots of fingers are placed thereon, and a thumb hole unit 61*c* which is formed between the placement board 61*a* and the placement bar 61*b*.

A printing finger positioning unit 62 which includes a printing finger inlet port 62*a* is provided on the placement board 61*a*, and non-printing finger receiving units 63*a* and 63*b* are formed respectively at the sides of the printing finger positioning unit 62. The printing finger positioning unit 62 and the non-printing finger receiving units 63*a* and 63*b* constitute the first finger receiving unit 60*a*.

The non-printing finger receiving units 63*a* and 63*b* are used when any one of the index finger, middle finger, ring finger and little finger is to be the printing finger.

In addition, a second finger receiving unit 60*b* is formed below the placement unit 61. The second finger receiving unit 60*b* is for receiving the non-printing fingers when the printing finger is the thumb. Further, the thumb hole unit 61*c* which is located between the placement board 61*a* and the placement bar 61*b* is formed immediately before (right in front of) the printing finger inlet port 62*a*. After the thumb which is the printing finger is inserted through the thumb hole unit 61*c* from below, the fingertip of the thumb is inserted in the printing finger inlet port 62*a*.

The above configurations of the third embodiment are similar to those of the second embodiment. However, the third embodiment is different from the second embodiment in the following respects.

That is, in the third embodiment, both ends of the placement bar 61*b* are joined respectively to the ends of arms 63, and the other ends of the arms 63 are rotatably supported respectively on the side boards of the lower machine casing

11*a* by axes 65. In addition, positioning units 64 by the concavo-convex engagement are formed respectively at the arms 63 and the side boards of the lower machine casing 11*a*. Specifically, the positioning is made by either of the concavo-convex engagement wherein concave portions are provided respectively at the arms 63 and convex portions are provided respectively at the side boards of the lower machine casing 11*a* or the concavo-convex engagement wherein convex portions are provided respectively at the arms 63 and concave portions are provided respectively at the side boards of the lower machine casing 11*a*. Thus, the placement bar 61*b* is maintained in an extruded state as shown in FIG. 8B which is a sectional view cut along the line VIII-VIII in FIG. 8A. When the nail print apparatus 1 is not in use, the placement bar 61*b* and the arms 63 are housed inside the second finger receiving unit 60*b*, that is, inside the lower machine casing 11*a*.

According to the nail print apparatus 1 of the third embodiment, following advantages are obtained.

That is, according to the nail print apparatus 1 of the third embodiment, it is needless to say that the advantages obtained in the second embodiment can be obtained, and also the nail print apparatus 1 can be minimized because the placement bar 61*b* and the arms 63 can be housed in the second finger receiving unit 60*b*, that is, in the lower machine casing 11*a* when the nail print apparatus 1 is not in use.

Fourth Embodiment

Figure 9A:
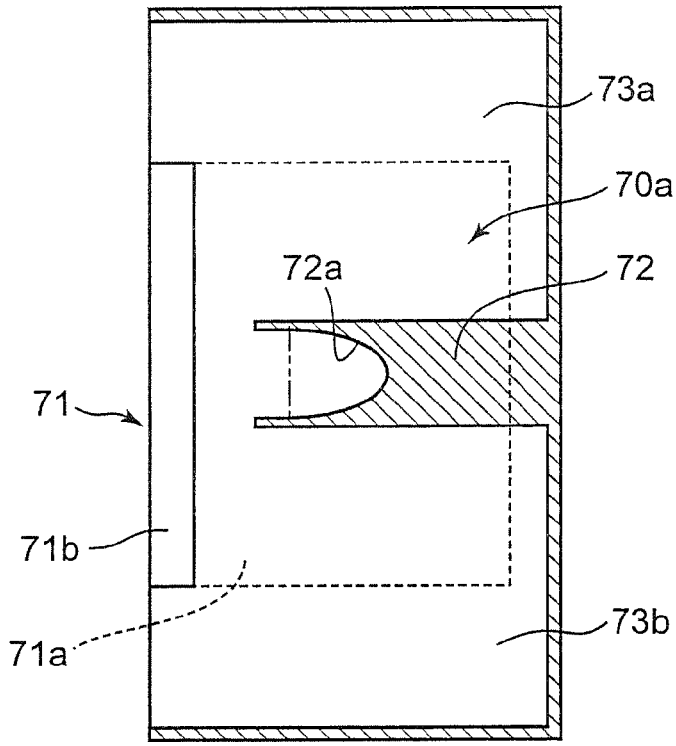
FIG. 9A is a diagram of finger receiving unit of the fourth embodiment of the nail print apparatus according to the present invention, which is a plan view of a part of the first finger receiving unit.
Figure 9B:
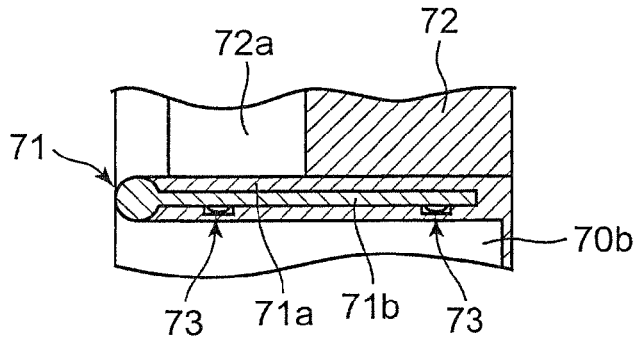
FIG. 9B is a diagram of finger receiving unit of the fourth embodiment of the nail print apparatus according to the present invention, which is a sectional view of a part of a printing finger positioning unit and a part of the second finger receiving unit in a state where a movable placement board is housed therein seen from the right side.
Figure 9C:
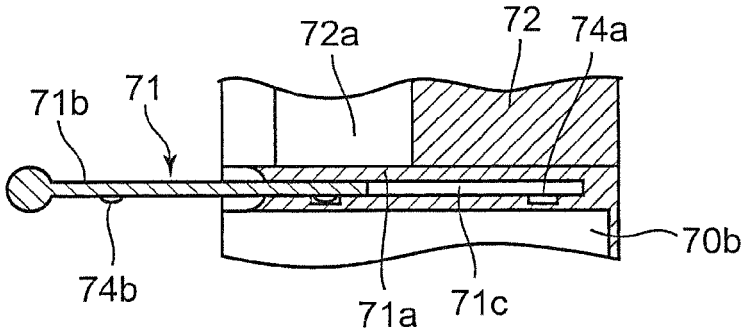
FIG. 9C is a diagram of finger receiving unit of the fourth embodiment of the nail print apparatus according to the present invention, which is a sectional view of a part of the printing finger positioning unit and a part of the second finger receiving unit in a state where the movable placement board is pulled out seen from the right side.

FIGS. 9A, 9B and 9C illustrate a placement unit of the nail print apparatus of the fourth embodiment.

As shown in FIG. 9A, the nail print apparatus 1 includes a fixed placement board 71*a* on which fingertips are placed and a movable placement board 71*b* which is located in front of the placement board 71*a* and bases or roots of fingers are placed thereon.

A printing finger positioning unit 72 which includes a printing finger inlet port 72*a* is provided on the placement board 71*a*, and non-printing finger receiving units 73*a* and 73*b* are formed respectively at the sides of the printing finger positioning unit 72. The printing finger positioning unit 72 and the non-printing finger receiving units 73*a* and 73*b* constitute a first finger receiving unit 70*a*.

Here, the movable placement board 71*b* is housed in a concave portion 71*c* which is formed in the placement board 71*a* so as to be able to slide in and out. Engagement units 73 each of which is configured by including a concave portion 74*a* and convex portion 74*b* formed by board springs are disposed at the placement board 71*a* and the movable placement board 71*b*. A thumb hole unit may be formed in the movable placement board 71*b*.

In addition, a second finger receiving unit 70*b* is formed below the placement unit 71. The second finger receiving unit 70*b* is for receiving the non-printing fingers when the printing finger is the thumb.

In the nail print apparatus 1, when any one of the index finger, middle finger, ring finger and little finger is to be the printing finger, the placement board 71*b* is used by being pulled out from the placement board 71*a* as shown in FIG. 9C.

On the other hand, in the nail print apparatus 1, when the thumb is to be the printing finger, the placement board 71*b* is housed in the placement board 71*a* as shown in FIG. 9B, the thumb to be the printing finger is inserted in the printing finger inlet port 72*a* and the other fingers are housed in the second finger receiving unit 70*b* which is formed below the placement board 71*a*.

According to the nail print apparatus 1 of the fourth embodiment, following advantages are obtained.

That is, according to the nail print apparatus 1 of the fourth embodiment, as in the case of the third embodiment, the nail print apparatus 1 can be minimized because the placement board 71*b* can be housed in the lower machine casing 11*a* when the nail print apparatus 1 is not in use.

Though embodiments of the present invention are explained above, the present invention is not limited to the embodiments and various modifications can be made.

Figure 10:
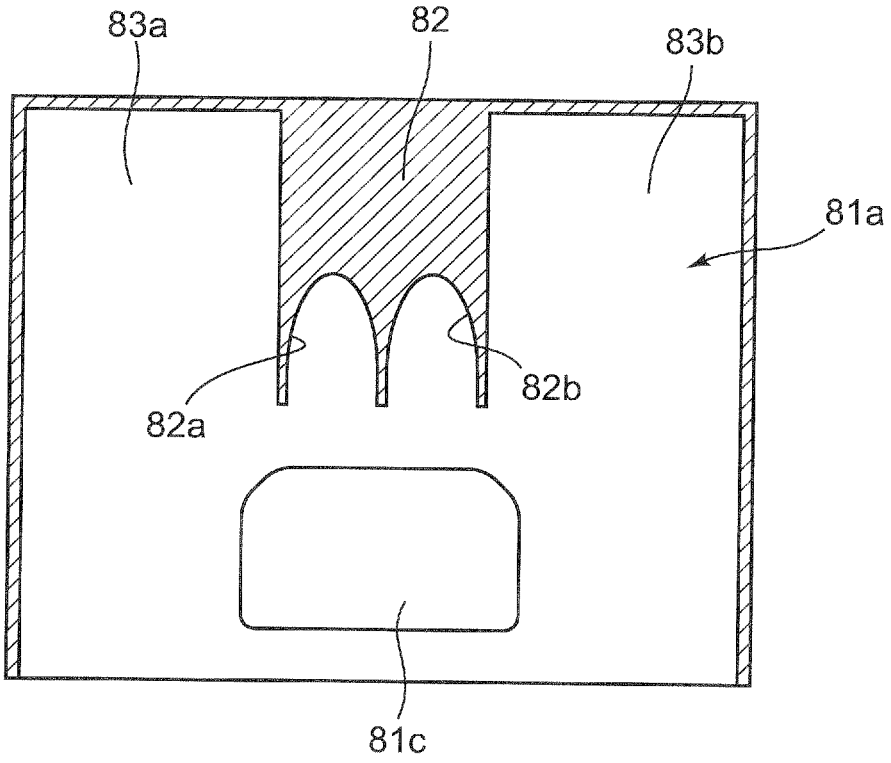
FIG. 10 is a plan view of apart of a first finger receiving unit of a modification example of the nail print apparatus according to the present invention.

For example, though printing finger positioning units 22, 52, 62 and 72 which hold one printing finger inlet port 23, 52*a*, 62*a* and 72*a* respectively are provided in the above embodiments, a printing finger positioning unit 82 which has two printing finger inlet ports 82*a* and 82*b* may be provided as shown in FIG. 10.

In such a case, when the thumbs of both hands are to be printed at the same time, the thumbs of both hands are inserted through the thumb hole unit 81*c* from below so as to press the sides of the thumbs of both hands against each other, and thereafter, the thumbs are inserted respectively in the printing finger inlet ports 82*a* and 82*b* of the thumbs, and the non-printing fingers other than the thumbs of both hands are inserted in the second finger receiving port (not shown in the drawings) below the placement board 81*a*. Non-printing finger receiving units 83*a* and 83*b* are formed respectively at the sides of the printing finger positioning unit 82.

Figure 11:
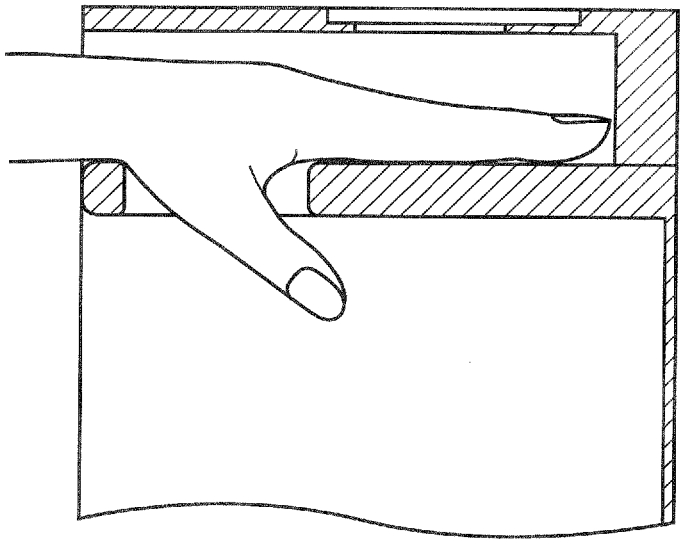
FIG. 11 is a sectional view of a part of the printing finger positioning unit and a part of the second finger receiving unit seen from the right side when the index fingers of both hands are to be printed at the same time by the nail print apparatus of the modification example shown in FIG. 10.

Also, when the index fingers of both hands are printed at the same time, thumbs of the both hands are inserted through the thumb hole unit 81*c* from above so as to press the upper surfaces of the thumbs against each other, and thereafter the other non-printing fingers of both hands are placed in the non-printing finger receiving units 83*a* and 83*b* as shown in FIG. 11.

According to one aspect of the preferred embodiments of the present invention, there is provided a nail print apparatus, including a print head which performs printing on a finger nail, a printing finger positioning unit which holds a fingertip of the finger nail on which the print head performs printing, non-printing finger receiving units which are provided respectively at sides of the printing finger positioning unit and which receive fingers other than the finger held by the printing finger positioning unit, and a placement unit on which at least the fingertip of the finger received by the printing finger positioning unit is placed.

Preferably, a thumb hole unit which is vertically penetrated and through which a finger is inserted is formed in the placement unit.

Preferably, the nail print apparatus further includes a machine casing which includes a first finger receiving unit which is provided on one surface of the placement unit and has an opening and a second finger receiving unit which is provided on the other surface of the placement unit and has an opening, and the printing finger positioning unit is provided in the first finger receiving unit, and a printing finger inlet port is provided at the printing finger positioning unit.

Preferably, the second finger receiving unit is another non-printing finger receiving unit which receives fingers other than the finger held by the printing finger positioning unit.

Preferably, the placement unit includes a placement board on which fingertips of fingers are placed and a placement bar on which bases of the fingers or a palm is placed, and a thumb hole unit is formed between the placement board and the placement bar.

Preferably, ends of the placement bar are joined to corresponding ends of arms respectively, and the other ends of the arms are rotatably supported on the machine casing by axes, respectively.

Preferably, a positioning unit which includes a concave portion or a convex portion is provided at each of the arms, and positioning is made by an engagement between the concave portion at each of the arms and convex portions at the machine casing or by an engagement between the convex portion at each of the arms and the concave portions at the machine casing.

Preferably, the placement bar is in a state of protruding from the machine casing and in a state of being housed inside the machine casing of when the positioning is made by the positioning unit of each of the arms.

Preferably, a concave portion is provided on a same side of a placement board as the openings, and a movable placement board is housed in the concave portion which is provided in the placement board so as to slide in and out.

Preferably, a thumb hole unit is formed in the movable placement board.

Preferably, a plurality of the printing finger inlet ports are provided at the printing finger positioning unit.

The entire disclosure of Japanese Patent Application No. 2011-157595 filed on Jul. 19, 2011 including description, claims, drawings, and abstract are incorporated herein by reference in its entirety.

What is claimed is:

1. A nail print apparatus, comprising:

a print head which is configured to perform printing on a finger nail of a printing finger;

a printing finger positioning unit which is configured receive the printing finger and to hold a fingertip of the printing finger;

non-printing finger receiving units which are provided respectively at sides of the printing finger positioning unit and which are configured to receive fingers other than the printing finger held by the printing finger positioning unit;

a placement unit which is arranged to have at least the fingertip of the printing finger received by the printing finger positioning unit placed thereon; and a machine casing which includes a first finger receiving unit which is provided at a first side of the placement unit and has an opening, and a second finger receiving unit which is provided at a second side of the placement unit and has an opening;

wherein the printing finger positioning unit is provided in the first finger receiving unit, and a printing finger inlet port is provided at the printing finger positioning unit.

2. The nail print apparatus according to claim 1, wherein a thumb hole unit through which a finger is insertable is formed in the placement unit so as to vertically penetrate the placement unit.

3. The nail print apparatus according to claim 1, wherein the second finger receiving unit is another non-printing finger receiving unit which is configured to receive fingers other than the printing finger held by the printing finger positioning unit.

4. The nail print apparatus according to claim 1, wherein the placement unit comprises a placement board which is arranged to have fingertips of fingers placed thereon, and a placement bar which is arranged to have bases of the fingers or a palm placed thereon, and wherein a thumb hole unit is formed between the placement board and the placement bar.

5. The nail print apparatus according to claim 4, wherein the placement unit further comprises arms which have first ends that are rotatably supported on the machine casing by axes, and second ends which are coupled to ends of the placement bar, respectively.

6. The nail print apparatus according to claim 5, wherein each of the arms comprises a positioning unit which includes a concave portion or a convex portion, and the arms are positioned by engagement between (i) a concave portion at each of the arms and convex portions at the machine casing, or (ii) a convex portion at each of the arms and concave portions at the machine casing.

7. The nail print apparatus according to claim 6, wherein the positioning units of the arms engage with the machine casing in a state in which the placement bar protrudes from the machine casing and in a state in which the placement bar is housed inside the machine casing.

8. The nail print apparatus according to claim 1, wherein the placement unit comprises a placement board which is arranged to have fingertips of fingers placed thereon;

wherein the placement board has a concave portion provided therein on a same side of the placement board as the openings of the first and finger receiving units; and wherein the placement unit further comprises a movable placement board which is housed in the concave portion so as to be slidable in and out.

9. The nail print apparatus according to claim 8, wherein a thumb hole unit is formed in the movable placement board.

10. The nail print apparatus according to claim 1, wherein a plurality of the printing finger inlet ports are provided at the printing finger positioning unit.

* * * * *